US005529099A

United States Patent [19]

Janek et al.

[11] Patent Number: 5,529,099

[45] Date of Patent: Jun. 25, 1996

[54] APPARATUS FOR METERING AND FILLING FLOWABLE VISCOUS OR PASTY PRODUCTS INTO CONTAINERS

[75] Inventors: Dieter Janek, Laupheim; Alfons Turtschan, Schwabisch-Hall; Olgert Uhdris, Budingen, all of Germany

[73] Assignee: Gasti Verpackungsmaschinen GmbH, Schwabisch-Hall, Germany

[21] Appl. No.: 106,110

[22] Filed: Aug. 12, 1993

[30] Foreign Application Priority Data

Aug. 12, 1992 [DE] Germany ..... 42 26 566.5

[51] Int. Cl.[6] ..... B65B 43/42; B67C 3/00

[52] U.S. Cl. ..... 141/129; 141/163; 141/185; 141/238; 141/94; 222/380

[58] Field of Search ..... 141/81, 97, 129, 141/137, 138, 163, 185, 237, 238, 243, 244, 245, 258, 311 A, 94; 222/361, 363, 375, 108, 380; 417/516, 517, 518; 277/188 R, 188 A, 189, 103

[56] References Cited

U.S. PATENT DOCUMENTS

| | | | |
|---|---|---|---|
| 105,328 | 7/1870 | Gregory | 141/242 |
| 3,850,345 | 11/1974 | Merritt | 141/258 |
| 4,231,578 | 11/1980 | Traub | 277/188 A |
| 4,341,329 | 7/1982 | Kuemmerer et al. | 222/380 |
| 4,462,568 | 7/1984 | Taylor et al. | 277/188 A |
| 4,917,158 | 4/1990 | Lingenhoff | 141/238 |
| 4,987,826 | 1/1991 | Deppert et al. | 277/188 R |
| 5,019,127 | 5/1991 | Böhm et al. | 141/258 |
| 5,040,579 | 8/1991 | Kawamura et al. | 141/258 |
| 5,230,373 | 7/1993 | Engler | 141/258 |

FOREIGN PATENT DOCUMENTS

| | | |
|---|---|---|
| 520344 | 6/1953 | Belgium . |
| 0383659A1 | 8/1990 | European Pat. Off. . |
| 0403813A1 | 12/1990 | European Pat. Off. . |
| 2321205 | 4/1973 | Germany . |
| 2321206 | 4/1973 | Germany . |
| 2814086B1 | 5/1979 | Germany . |
| 3817418 | 5/1988 | Germany . |

*Primary Examiner*—J. Casimer Jacyna
*Assistant Examiner*—Steven O. Douglas
*Attorney, Agent, or Firm*—Herbert Dubno

[57] ABSTRACT

A filling machine for pasty or viscous products, especially fruit products and particularly a multirow filling machine for producing assortments of the packaged product, has for each row at least one metering or dosing station in which the metering piston is displaceable in a cylinder formed directly in the metering housing and adjacent a valve cylinder in which the valve member is provided. The valve member and piston are guided directly on the wall of the respective cylinders in this housing while the respective piston rods and stem extend upwardly through easily replaceable seals accessible from an observation space above the housing.

10 Claims, 5 Drawing Sheets

APPARATUS FOR METERING AND FILLING FLOWABLE VISCOUS OR PASTY PRODUCTS INTO CONTAINERS

FIELD OF THE INVENTION

The present invention relates to an apparatus for metering or filling flowable products, usually pasty or viscous products, especially fruit yogurt or the like into respective containers displaced along a container path. The invention is especially directed to the filling of an assortment of such products, preferably on a multirow aseptic filling and metering machine.

BACKGROUND OF THE INVENTION

Machines for the aforedescribed purpose, i.e. for metering and filling viscous or pasty products and especially for the filling of product assortments like fruit yogurt containers for various fruits or fruit combinations, and preferably in multirow aseptic machines, generally have for each row of containers advanced past a filling station, a respective metering device which is connected to a supply of the product to be packaged and has an outlet for a metered amount of the packaged product. The control of the flow of the product is effected by a product. The control of the flow of the product is effected by a valve slider having a valve stem and a metering piston is provided for displacing a fixed quantity of the product at each stroke through the outlet and into the container, as controlled by a piston rod connected to that piston.

An apparatus of this type is described in German printed application DE-AS 23 21 206.

In the metering device of this apparatus, the metering piston and a the control band are received in respective cylinders which are axially and laterally offset from one another. The metering piston and its piston rod and the control valve and its valve stem are guided in respective caps closing individual cylinders and having different types of seals, for example, the metering piston and a sealing sleeve of a bellows type.

The sealing devices for both piston rod and the valve stem of this earlier arrangement have significant drawbacks, especially when the sealing effect breaks down.

The result is significant inaccuracy in metering of the product into the container. In practice, considerable work and time are required to dismount the seals and replace them when wear necessitates such replacement.

Wear of the seals is especially pronounced when assortment packaging is carried out. In such cases, the individual rows of containers are filled with different products, for example, fruit yogurt containing raspberries, fruit yogurt the yogurt, the high seed content gives rise to more rapid wear of the seal than is the case where products with lesser amounts of seed or seedless products are packaged and hence the seals more prone to wear must be replaced more rapidly.

In practice it is found that certain seals must be replaced to avoid problems in the metering and filling operation while others may not have to be replaced.

In practice, however, all seals at the metering pistons are replaced whenever the machines are brought down for a seal change.

In a filling machine of the multiple-row type, this seal replacement, utilizing the conventional machine construction, can take considerable time and for that period of time the machine must be out of production. Since the disassembly of the upper part of the individual cylinders is complex and time consuming, the time required for seal change is excessive. Furthermore, cleaning of the earlier metering unit by flushing the valve and piston or plunger from all sides cannot readily be carried out.

While in our opinion DE-AS 23 21 206 represents the closest art of which we currently have knowledge, mention may be made of German patent DE 38 17 418 and German open application DE-OS 23 21 205 which respectively show another multirow filling machine and a structure similar to that of DE-AS 23 21 206, as state of the art.

OBJECTS OF THE INVENTION

It is, therefore, the principal object of the present invention to provide a metering and filling machine, especially a machine which can be used for the filling of an assortment of products like, for example, fruit yogurts of various flavors or the like, and preferably a multirow aseptic machine, whose metering device has simpler seals and with relatively simple means can provide an effective sealing of the metering or dosing unit.

Another object of the invention is to provide a filling machine of the type described which affords more exact control and monitoring of product leakage without affecting the metering precision and in such manner as will allow the packaged product to remain sterile and/or clean.

It is also an object of this invention to provide an improved apparatus which avoids the drawbacks of earlier devices.

SUMMARY OF THE INVENTION

These objects and others which will become apparent hereinafter are attained, in accordance with the invention by providing that the metering or dosing piston and the control valve or slider is directly guided in the metering housing and that the extensions of the piston rod of the metering piston from the rear side of this cylinder and the extension of the piston rod of the valve slider from the rear side of the inlet chamber each are sealed in a common plane of the housing by a respective easily replaceable sealing body.

More particularly, the apparatus for metering predetermined quantities of the viscous or pasty product into respective containers, especially a multiplicity of rows of such containers for the packaging of an assortment of the product, can include for each row a respective metering housing. The apparatus can comprise, therefore, means for advancing at least one row of the containers along a path past a metering and filling station;

a one-piece dosing housing above the path at the station having an outlet successively alignable with the containers for filling the product into same;

a dosing cylinder formed directly in the housing for receiving a quantity of the product;

a valve chamber formed directly in the housing parallel to and communicating with the dosing cylinder and with a source of the product;

a dosing piston reciprocatable in the dosing cylinder and guided directly by a wall of the housing to draw the product into the dosing cylinder and drive the product from the dosing cylinder into a container aligned with the outlet;

a slide valve in the valve chamber and guided directly by a wall of the housing for controlling flow of the product into and out of the dosing cylinder and into the outlet, the dosing piston and the slide valve being shiftable parallel to one another in the dosing housing;

a piston rod on the dosing piston extending rearwardly away from the piston and emerging from the housing at an end of the cylinder remote from the outlet;

a valve stem on the slide valve extending rearwardly away from the slide valve and emerging from the housing through a product-inlet chamber at an end of the valve chamber remote from the outlet; and respective readily replaceable sealing bodies engaging the piston rod and the valve stem at the ends of the cylinder and chamber, respectively, and at the same end of the housing for sealing the housing with respect to the rod and the stem.

The metering device of the invention provides between the control surfaces of the control valve and the associated wall of the housing and between the piston and associated cylinder wall of the housing no separate housing. Only a single seal is provided for each of the pistons and the valve and these individual seals are easily replaceable at the same level of the housing, in the region of the piston rod and the valve stem. A leakage past these seals, therefore, can have no effect on the metering precision so that the metering device and a filling and closing machine utilizing same can be driven for at least a limited time after substantial leakage can occur.

Only when the control or monitoring of the leakage shows that the quantity of the product which is leaking has exceeded an economically tolerable amount, is it necessary or desirable to replace the sealing body with an new one. That operation can take place, according to the invention, also in a relatively simple manner.

The monitoring of the leakage can be effected especially conveniently when the sealing bodies separate the cylinder of the piston and the product inlet space of the valve stem from a monitoring space in which the leaked product can collect. This monitoring space can also be provided as a sterile space in an aseptic machine and can be sealed in the region of the piston rod and the valve stem against ambient atmosphere by respective sterile air gates or locks.

To facilitate replacement of the sealing bodies, the piston rod and the valve stem can be subdivided in the region of the monitoring space and the latter can have an access opening which can be closed by a cover and at least one observation window.

The upper and lower segments of the piston rod and of the valve stem can each have a plug and socket connection secured by a transverse pin so that the axial forces required for actuating the metering piston and the control valve can be supplied accurately. This type of plug and socket connection enables transmission of any requisite torques for use of the valve member as a rotary valve member.

The sealing bodies are held in place by a quick release element which can preferably be shiftable horizontally to lock and unlock the sealing bodies. For example, one horizontally actuatable latch can be used to retain the sealing bodies of both the piston rod and the valve stem and, if desired, the sealing bodies of the piston rod and valve stem of an adjacent filling row.

Each sealing body can be supported by a support plate and braced against a cover plate. The latter can have two substantially diametrically opposite ring segmental locking collars which can facilitate removal of the sealing elements by an appropriately-shaped tool.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
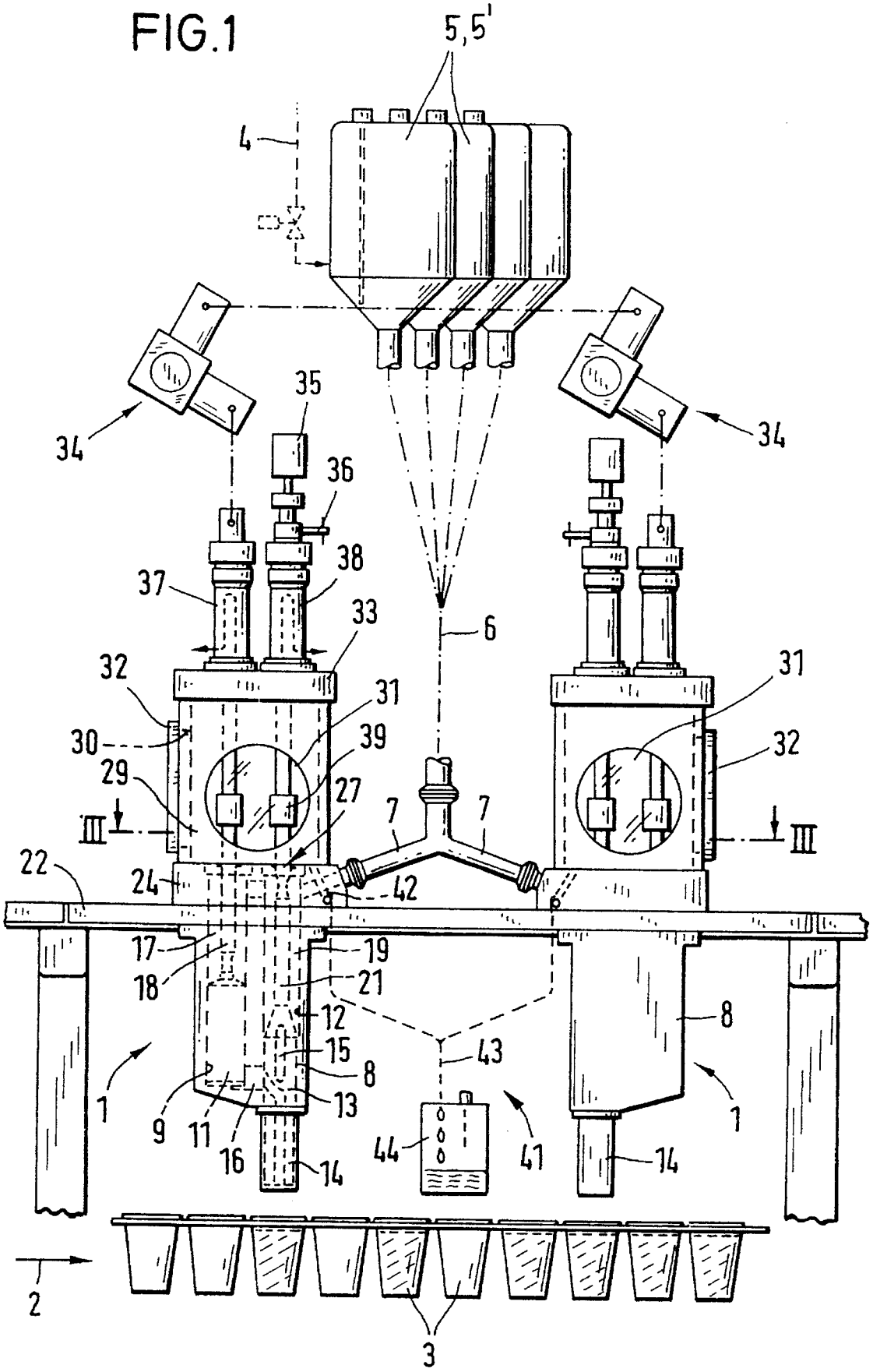
FIG. 1 is a diagrammatic elevational view of a machine for filling four different products into eight rows of containers with two individual metering stations for each product row, as seen from the side.
Figure 2:
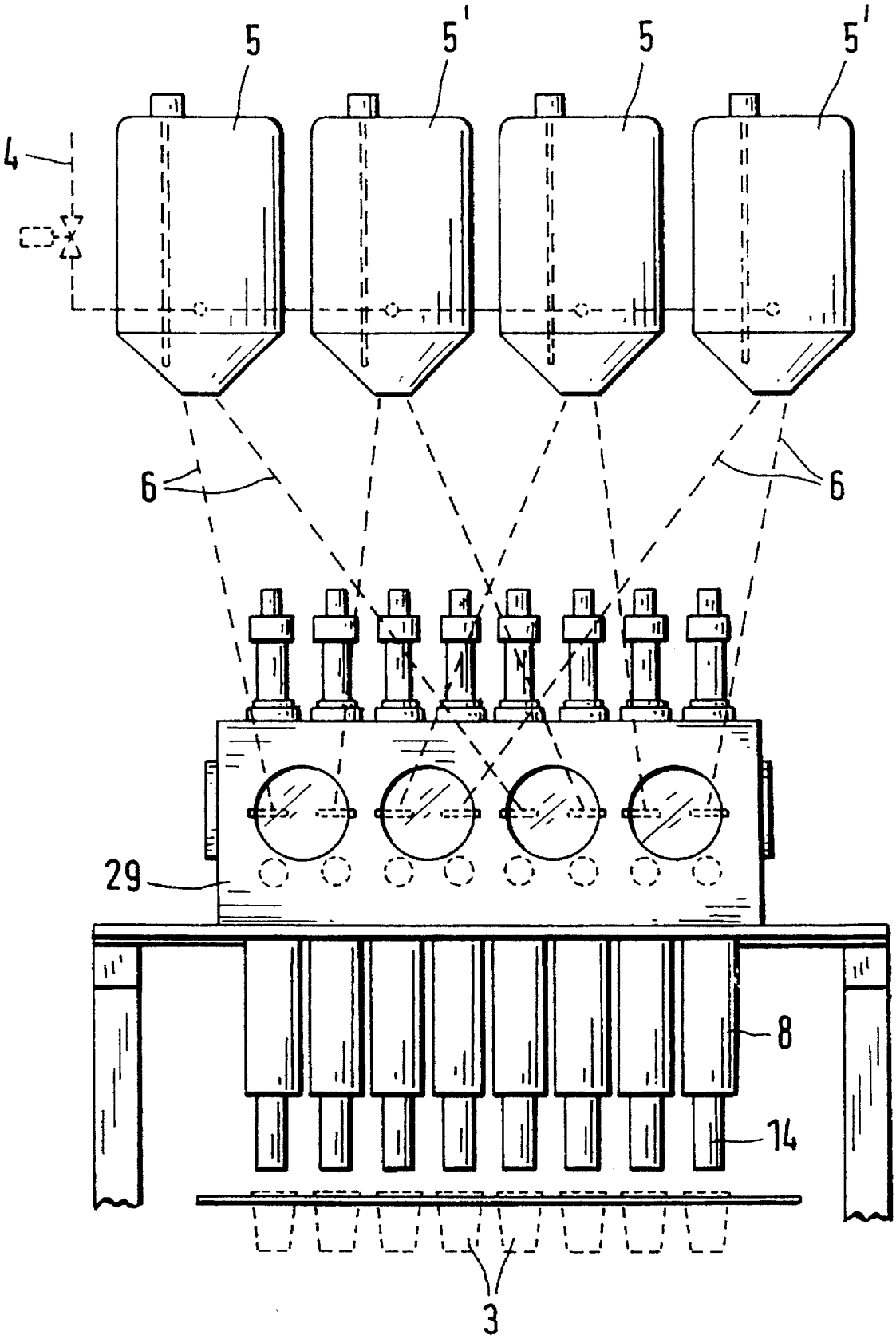
FIG. 2 is an end view of the metering and filling machine, also in highly diagrammatic form.
Figure 3:
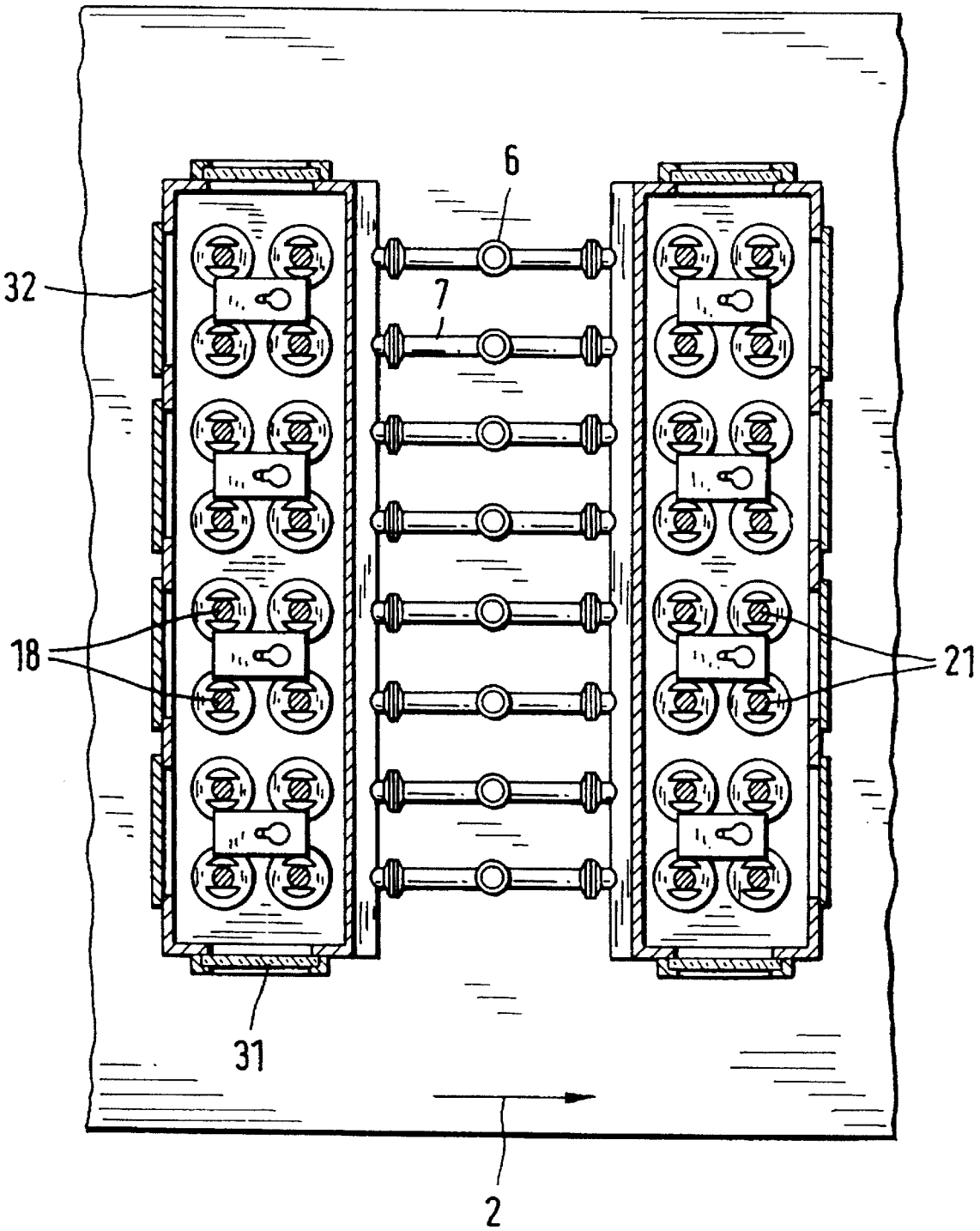
FIG. 3 is a section along the line III—III of FIG. 1.

The basic elements of a multirow machine for producing an assortment of packages of a product, for example, fruit yogurt of different flavors, where the product is a pasty or viscous substance, have been shown in FIGS. 1–3. Details of the machine which are not relevant to the improvement in the dosing and metering unit have not been supplied and are not described in detail.

The machine is intended to fill eight adjacent rows of containers 3 with four different flavors of fruit yogurt, a container-closing portion and the container assortment packaging portion of the machine having not been illustrated at all.

As can be seen from FIGS. 1 and 3, each row of containers 3 along the transport path 2 has displaced by an appropriate conveyor not shown in detail, is provided with two metering or dosing devices at respective stations along the path each station filling alternate cups or containers.

The product filled into each cup can be prepared by mixing at least two components, e.g. the yogurt and the flavoring fruits, in adjustable proportion in a mixing vessel not shown and from which the mixed product is delivered via a conduit 4 directly to a respective product vessel 5, 5', 5", 5"' of the filling and closing machine.

From each product vessel 5, 5', 5", 5"', the respective product is supplied via a feedline 6 and a distributing pipe 7 to the respective dosing units 1 of the respective row. From FIG. 2 it will be apparent which of the rows of containers are filled with which product.

Each of the dosing units 1 is formed with a single dosing or metering housing 8 provided unitarily, i.e. in one piece, with a cylinder bore 9 receiving a metering or dosing piston 11 and a cylinder bore 12 forming with a control slider 13 a control valve for regulating the flow of the viscous or pasty product to be packaged.

The control slider 13 controls the product feed to the metering cylinder and from the metering cylinder to the outlet 14 which delivers the product to the container. The outlet 14 is a mouthpiece which ensures sterile delivery. The control slider 13 has a connecting slit 15 and a passage 16 via which, depending upon the angular position of the rotatable slider 13, a connection can be made or broken between the valve and the space in the cylinder ahead of the metering piston 11, also referred to as a metering or dosing space.

At its rear or upper side, the metering or dosing piston 11 is disposed in a cylinder chamber 17 through which the piston rod 18 of the piston 11 extends. In a similar manner, the rear side of the control slider 13 is disposed in an inlet space 19 to which the product is initially fed and through which the stem 21 of the valve slider 13 extends.

Above the housing 8 and in a support body 24 to which a support plate 22 is connected, a passage 25 connects the spaces 17 and 19 behind the piston 11 and the valve slider 13, respectively. The housing 8 is suspended by bolts, (not shown) from the support plate 22.

Sealing bushings 23 are provided in the support plate 22 to form annular seals between the housing 8 and the body 24. The body 24 is also provided with an inlet conduit 26 connected to the respective branch pipe 7 which, in turn, is connected to the feed pipe 6 for the pasty or viscous substance.

The extension of the piston rod 18 and the extension of the stem 21 from the rear cylinder chamber 17 and the inlet space 19 are sealed by respective sealing bodies 27, i.e. lip-type sealing rings.

Each sealing ring 27 is received in a substantially cylindrical recess or seat 28 of the support body 24 and seals the cylinder chamber 17 and the inlet space 19 with respect to a monitoring space 29 which, in the case of an aseptic machine, is formed as a sterile chamber. This sterile chamber 29 serves to enable observation and control of leakage past the sealing rings 27.

The monitoring space 29 has a wall formed with at least one observation window 31 and an opening 30 through which the seals can be replaced and which is closed by a removable cover 32.

The monitoring space is closed by a head plate 33. As can be seen from FIG. 1, the piston rod 18 and the stem 21 traverse the head place 33 of the monitoring space 29 and extend to an elevator or vertical drive 34 for the piston rod 18 and a piston-and-cylinder unit 35 for the stem 21. These two drives raise and lower the piston 18 and the stem 21.

A lever 36 is provided for coupling the valve stem to a drive, not shown, and which enables rotation of the control slider or valve 13 about its axis by about 90° as mentioned above to close or open the product flow path to the metering cylinder and the piston 11.

The monitoring space 29 is sealed against the ambient atmosphere in the regions of the piston rod 18 and the stem 21 by conventional air gates or locks 37, 38 to maintain sterility with no sealing wear in the region of the piston rod 18 and the stem 21.

From FIG. 1 it will also be apparent that the piston rod 18 and the stem 21 are subdivided longitudinally in the region of the observation space 29 with the segments of the rod and stem in each case being interconnected by a tool releasable plug-and-socket connection 39. The significance of this subdivision of the piston rod and the stem will be clear below.

In addition, FIG. 1 shows an automatic leakage monitoring device 41. This comprises run-off bores 42 and a manifold 43 running between the bores 42 and the leakage collection vessel 44. The leaked product can collect in the vessel 44 showing immediately how much leakage there has been.

Figure 4:
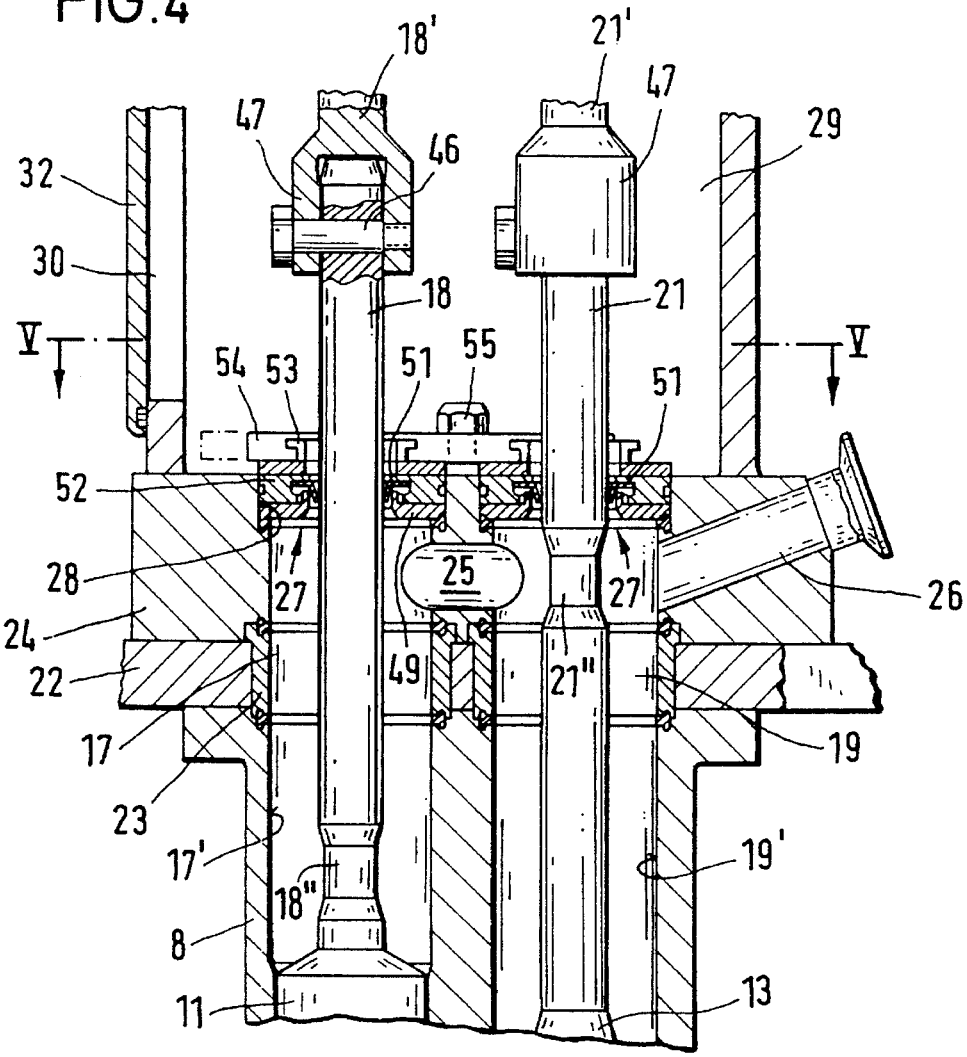
FIG. 4 is a longitudinal section through a portion of the metering device, drawn to a larger scale.
Figure 6:
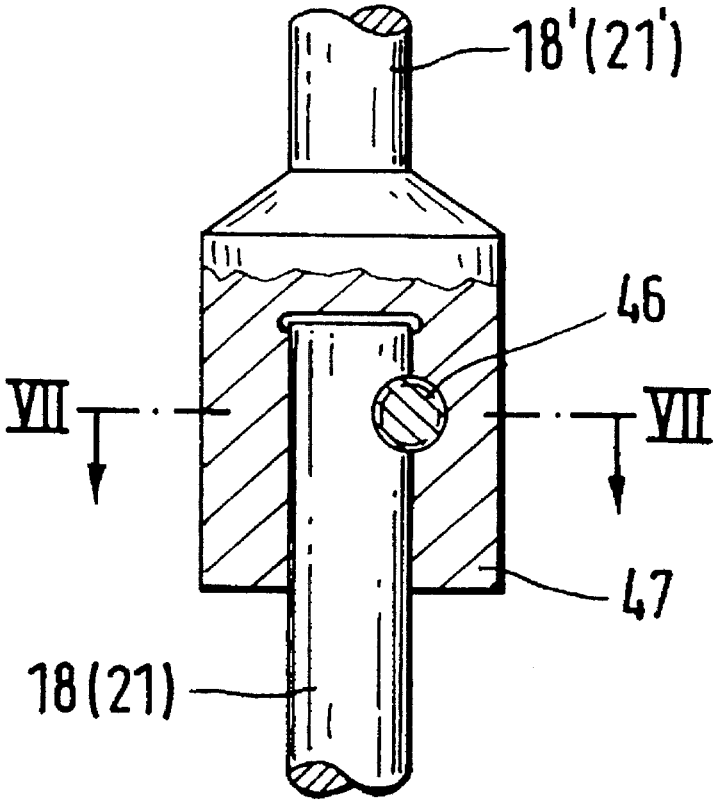
FIG. 6 is a detail of the connection between two segments of the piston rods or of the valve stem.
Figure 7:
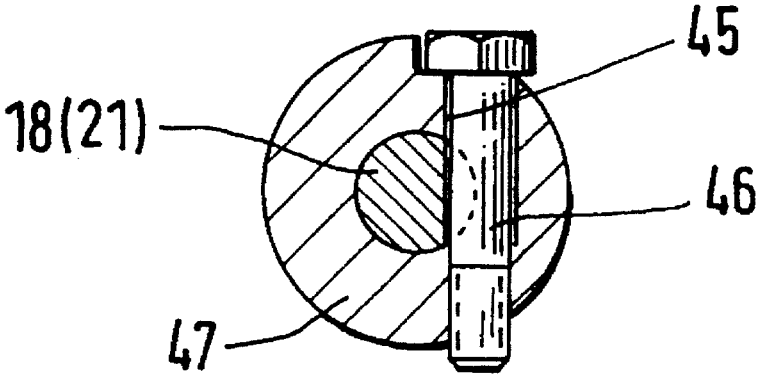
FIG. 7 is a section taken along the line VII—VII.

As will be apparent from FIG. 4, 6 and 7, the connection 39 has a lateral recess 45 in the piston rod 18 or the stem 21, through which a bolt 46 can extend and the bolt 46 can be threaded into an enlarged head portion 47 of the upper segment 18' or 21' of the piston rod 18 or the stem 21.

In this manner, exact transfer of the axial forces to the rod and stem and, in the case of the stem 21, the requisite torque for rotating the control valve, can be delivered.

Figure 5:
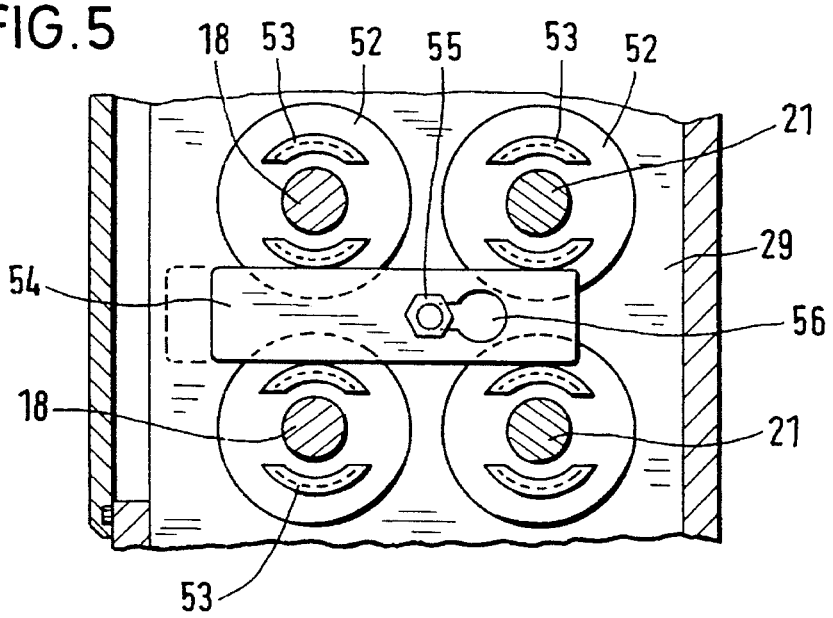
FIG. 5 is a section taken along the line V—V of FIG. 4.

As will be apparent from FIGS. 4 and 5, each sealing body or ring 27 for the piston rod 18 or the stem 21, comprises a lower support plate 49 lying on one side of the respective sealing element 51.

This dished or cup-shaped sealing element can be a conventional commercially-available sealing element or can be fabricated specifically for the purpose described, it being understood that all of the sealing elements used here are identical and interchangeable with one another.

On the opposite side of the sealing element 51, there is provided a cover plate 52 which is formed with a pair of spaced apart, diametrically opposite and substantially ring segmental locking collars 53. These locking collars cooperate with a horizontally shiftable and removable locking slider 54 which can be held in place by a clamping screw 55 and, upon loosening, a clamping screw 55 can be slid in an unlocking direction to allow removal of the slider from the screw.

The slider 54 engages over the cover plates 52 of four seals, namely, the two seals of one station and the two seals of a station of an adjoining row.

The slider 54 can have a keyhole slot so that upon its movement into a position in which the head of the keyhole wall is aligned with the head of the bolt 55, the slider can be readily removed.

As soon as an automatic leakage detector so indicates or, from observation through the window 31 of the monitoring space 29, excessive leakage is detected, and replacement of a sealed ring 27 is necessary, the seal replacement can be initiated.

After the machine is brought to standstill, the cover 32 of the opening 30 is removed or opened and the plug and socket connections for the piston rod and the stem are released.

The upper segments 18' and 21' of the piston rod 18 and the stem 21 are brought into their uppermost positions while the lower segments are pressed downwardly into their lowermost positions.

The bolt 55 is loosened and the slider 54 is removed utilizing an appropriate tool engaging the locking collars 53, the sealing elements are drawn upwardly and replaced by new sealing elements 51. The parts are reconnected or returned to their original positions in the opposite sequence.

Experience has shown that a change of the sealing bodies can be effected rapidly and because of the visual or automatic leakage monitoring need only be undertaken when the monitoring shows excessive leakage. Since the seal is located only in the region of the piston rod or stem, production can continue in spite of such leakage, since the leakage does not affect the accuracy of metering the product into the container.

Because of the comparatively small number of seals, the metering device of the invention is easily sterilized so that filling of the containers can be effected under aseptic conditions. Cleaning can be facilitated by enlarging the annular space 17' of the cylinder 17 so that when the piston 11 is drawn into this enlargement, it can be flushed all around with the flushing and sterilizing solution. A corresponding enlargement 19' in the inlet space 19 can also be provided to allow the valve member 13 to be flushed all around as well.

A cleaning of the piston rod 18 and the stem 21 in the region of the respective seal 27 can be effected by raising the piston rod and the stem until small diameter regions or constructions 18" and 21" are disposed in the region of the seals 27.

It will be understood that the invention is also applicable to variations within the spirit and scope of the appended claims and for compositions other than fruit yogurt, for example, dairy products like cottage cheeses, to marmalades and fruit pulp.

We claim:

1. An apparatus for metering predetermined quantities of a flowable or pasty product into respective containers, said apparatus comprising:

means for advancing at least one row of said containers along a path past a metering and filling station;

a one-piece dosing housing above said path at said station having an outlet successively alignable with said containers for filling said product into same;

a dosing cylinder formed directly in said housing for receiving a quantity of said product;

a valve chamber formed directly in said housing parallel to and communicating with said dosing cylinder and with a source of said product;

a dosing piston reciprocatable in said dosing cylinder and guided directly by a wall of said housing to draw said product into said dosing cylinder and drive said product from said dosing cylinder into a container aligned with said outlet;

a slide valve in said valve chamber and guided directly by a wall of said housing for controlling flow of said product into and out of said dosing cylinder and into said outlet, said dosing piston and said slide valve being shiftable parallel to one another in said dosing housing;

a piston rod connected to said dosing piston extending rearwardly away from said piston and emerging from said housing at an end of said cylinder remote from said outlet;

a valve stem connected to said slide valve extending rearwardly away from said slide valve and emerging from said housing through a product-inlet chamber at an end of said valve chamber remote from said outlet;

respective replaceable sealing bodies engaging said piston rod and said valve stem at said ends of said cylinder and chamber, respectively, and at the same end of said housing for sealing said housing with respect to said rod and said stem; and means forming a monitoring space for collecting leaked product on said housing, said sealing bodies engaging said piston rod and said valve stem respectively being arranged between said cylinder and said space and between said product-inlet chamber and said space, said monitoring space is formed as a sterile chamber formed with sterile air locks separating said monitoring space from ambient atmosphere in regions where said piston rod and said stem traverse said monitoring space.

2. An apparatus for metering predetermined quantities of a flowable or pasty product into respective containers, said apparatus comprising:

means for advancing at least one row of said containers along a path past a metering and filling station;

a one-piece dosing housing above said path at said station having an outlet successively alignable with said containers for filling said product into same;

a dosing cylinder formed directly in said housing for receiving a quantity of said product;

a valve chamber formed directly in said housing parallel to and communicating with said dosing cylinder and with a source of said product;

a dosing piston reciprocatable in said dosing cylinder and guided directly by a wall of said housing to draw said product into said dosing cylinder and drive said product from said dosing cylinder into a container aligned with said outlet;

a slide valve in said valve chamber and guided directly by a wall of said housing for controlling flow of said product into and out of said dosing cylinder and into said outlet, said dosing piston and said slide valve being shiftable parallel to one another in said dosing housing;

a piston rod connected to said dosing piston extending rearwardly away from said piston and emerging from said housing at an end of said cylinder remote from said outlet;

a valve stem connected to said slide valve extending rearwardly away from said slide valve and emerging from said housing through a product-inlet chamber at an end of said valve chamber remote from said outlet, each of said piston rod and said stem being subdivided into at least two segments in said monitoring space;

respective replaceable sealing bodies engaging said piston rod and said valve stem at said ends of said cylinder and chamber, respectively, and at the same end of said housing for sealing said housing with respect to said rod and said stem; and means forming a monitoring space for collecting leaked product on said housing, said sealing bodies engaging said piston rod and said valve stem respectively being arranged between said cylinder and said space and between said product-inlet chamber and said space, said means forming said monitoring space including walls surrounding said monitoring space and formed with at least one observation window and with an opening affording access to said sealing bodies for replacement thereof, said opening being closed by a cover.

3. The apparatus defined in claim 2 wherein the segments of said piston rod include an upper piston rod segment connected with a lower piston rod segment by a transverse pin and the segments of said valve stem include an upper valve stem segment connected with a lower valve stem segment by a transverse pin.

4. The apparatus defined in claim 3 wherein each of said upper segments is formed with an enlarged head portion receiving the respective lower segment in a plug-and-socket connection and the respective transverse pin is a bolt threaded into the respective head portion through a bore laterally offset from an axis of the respective head portion.

5. The apparatus defined in claim 2, further comprising a respective quick connect element securing each of said sealing bodies in place, wherein said quick-connect element is a substantially horizontally slidable removable latch secured against movement by a bolt and shiftable and removable upon loosening of said bolt.

6. The apparatus defined in claim 5 wherein said latch simultaneously secures both of said sealing bodies in respective seats.

7. The apparatus defined in claim 6 wherein said latch simultaneously secures sealing bodies in respective seats for a piston rod and valve stem for another row of containers displaced along said path.

8. An apparatus for metering predetermined quantities of a flowable or pasty product into respective containers, said apparatus comprising:

means for advancing at least one row of said containers along a path past a metering and filling station;

a one-piece dosing housing above said path at said station having an outlet successively alignable with said containers for filling said product into same;

a dosing cylinder formed directly in said housing for receiving a quantity of said product;

a valve chamber formed directly in said housing parallel to and communicating with said dosing cylinder and with a source of said product;

a dosing piston reciprocatable in said dosing cylinder and guided directly by a wall of said housing to draw said product into said dosing cylinder and drive said product from said dosing cylinder into a container aligned with said outlet;

a slide valve in said valve chamber and guided directly by a wall of said housing for controlling flow of said product into and out of said dosing cylinder and into said outlet, said dosing piston and said slide valve being shiftable parallel to one another in said dosing housing;

a piston rod connected to said dosing piston extending rearwardly away from said piston and emerging from said housing at an end of said cylinder remote from said outlet;

a valve stem connected to said slide valve extending rearwardly away from said slide valve and emerging from said housing through a product-inlet chamber at an end of said valve chamber remote from said outlet;

respective replaceable sealing bodies engaging said piston rod and said valve stem at said ends of said cylinder and chamber, respectively, and at the same end of said housing for sealing said housing with respect to said rod and said stem, each of said sealing bodies being provided in a respective seat and having a side of the respective sealing body turned toward said outlet and an opposite side, a support plate in each seat bracing the respective sealing body on a side thereof turned toward said outlet, a cover plate lying on the opposite side of the respective sealing body, each of said cover plates being formed with diametrically opposite substantially ring segmentally shaped locking collars.

9. The apparatus defined in claim 8 wherein said seats are substantially cylindrical recesses formed in a support body on a support plate from which said housing is suspended and provided with a passage between said cylinder and said product-inlet chamber, said housing being releasably bolted to said support plate, respective sleeves traversing said support plate in line with said recesses.

10. The apparatus defined in claim 9 wherein said support body is provided with an inlet for said product communicating with said product-inlet chamber, and a product-outlet line extending from said monitoring space to a manifold collecting leaked product and delivering same to a collecting vessel.

* * * * *